US008303319B2

(12) United States Patent
Yu et al.

(10) Patent No.: US 8,303,319 B2
(45) Date of Patent: Nov. 6, 2012

(54) ELECTRICAL CARD CONNECTOR WITH IMPROVED CONTACTS

(75) Inventors: Jian-Fei Yu, Kunshan (CN); Xi-Fu Xu, Kunshan (CN); Xiao-Ming Huang, Kunshan (CN); Qi-Jun Zhao, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/108,011

(22) Filed: May 16, 2011

(65) Prior Publication Data

US 2011/0281446 A1 Nov. 17, 2011

(30) Foreign Application Priority Data

May 14, 2010 (CN) ..... 2010 2 0190621

(51) Int. Cl.
*H01R 13/62* (2006.01)

(52) U.S. Cl. ..... 439/152

(58) Field of Classification Search ..... 439/92, 439/629–630, 152, 660, 108, 76.1, 159
See application file for complete search history.

(56) References Cited

U.S. PATENT DOCUMENTS

| | | | | |
|---|---|---|---|---|
| 6,945,824 | B1 * | 9/2005 | Li et al. | 439/660 |
| 7,044,797 | B1 * | 5/2006 | Lai | 439/630 |
| 7,614,920 | B1 | 11/2009 | Yi | |
| 7,686,652 | B2 | 3/2010 | Yu et al. | |
| 7,862,346 | B1 * | 1/2011 | Wan et al. | 439/79 |
| 2005/0221649 | A1 * | 10/2005 | Tanaka et al. | 439/159 |

* cited by examiner

*Primary Examiner* — Jean F Duverne
(74) *Attorney, Agent, or Firm* — Wei Te Chung; Ming Chieh Chang

(57) ABSTRACT

An electrical connector includes an insulative housing having an inserting slot, and a bottom wall under the inserting slot. The bottom wall defines a supporting surface extending along a front-to-back direction, a horizontal guiding surface located in front of the supporting surface, and a plurality of depressions recessed from the supporting surface and arranged in one row along a transverse direction perpendicular to the front-to-back direction. A plurality of first contacts each has a planar first contact portion retained in the depression. A plurality of second contacts each has an arc-shaped second contact portion extending upwardly beyond the supporting surface and protruding into the inserting slot. The second contact portions are located behind the first contact portions.

18 Claims, 8 Drawing Sheets

ELECTRICAL CARD CONNECTOR WITH IMPROVED CONTACTS

BACKGROUND OF THE INVENTION

1. Field of the Invention

The present invention generally relates to an electrical card connector and more particularly to an electrical card connector with improved contacts.

2. Description of Related Art

A conventional electrical card connector is usually used in electrical equipments such as desktop, notebook, mobile phones and the like for contacting with various types of memory card to transmit information therebetween. The electrical card connector is mounted on a printed circuit board, and comprises an insulative housing defining an inserting slot for receiving a memory card, and a plurality of contacts retained in the insulative housing. The contacts may each has a contact portion extending into the inserting slot, a soldering portion projecting outside the insulative housing to be soldered onto a printed circuit board, and a retaining portion connecting with the contact portion and the soldering portion. The contact portions are deflected to contact the memory card which is inserted into the inserting slot. However, the memory card connector may not satisfy requirement of users in future during users require many kinds of application requirements.

So it is necessary to provide a new electrical connector to solve the problems above.

SUMMARY OF THE INVENTION

According to one aspect of the present invention, an electrical card connector comprises: an insulative housing having an inserting slot, and a bottom wall under the inserting slot, the bottom wall defining a supporting surface extending along a front-to-back direction, a horizontal guiding surface located in front of the supporting surface, and a plurality of depressions recessed from the supporting surface and arranged in one row along a transverse direction perpendicular to the front-to-back direction, the guiding surface disposed lower than the supporting surface, the depressions being communicated with the inserting slot; a plurality of first contacts each having a planar first contact portion retained in the depression, a first soldering portion extending beyond the insulative housing, and a first retaining portion connecting with the first contact portion and the first soldering portion; and a plurality of second contacts each having an arc-shaped second contact portion extending upwardly beyond the supporting surface and protruding into the inserting slot, a second soldering portion extending beyond the insulative housing, and a second retaining portion connecting with the second contact portion and the second soldering portion, the second contact portions located behind the first contact portions.

According to another aspect of the present invention, an electrical card connector for receiving a memory card with a row of elastic contact pads and another row of non-elastic contact pads behind the elastic contact pads, comprises: an insulative housing defining an inserting slot extending along a front-to-back direction; a plurality of first contacts received in the insulative housing and including a first pair of differential contacts, a second pair of differential contacts, and a first grounding contact located between the first and second pairs of differential contacts, each of the first contacts comprising a first non-elastic contact portion exposed in the inserting slot for engaging with the elastic contact pad of the memory card, a first soldering portion located on a rear side of the insulative housing; and a plurality of second contacts received in the insulative housing and including a power contact, a second grounding contact, and a third pair of differential contacts located between the power contact and the second grounding contact, each of the second contacts comprising a second elastic contact portion exposed in the inserting slot and located higher than the first contact portions, and a second soldering portion located on a rear side of the insulative housing, the second contact portions adapted for engaging with the non-elastic contact pads of the memory card; wherein the first and second soldering portions are arranged in one row in a transverse direction perpendicular to the front-to-back direction, the first grounding contact defines a split to form two first soldering portions spaced from each other in the transverse direction, the second soldering portions of the third pair of differential contacts are arranged between and directly adjacent to the two first soldering portions of the first grounding contact.

Other objects, advantages and novel features of the present invention will become more apparent from the following detailed description of the present embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
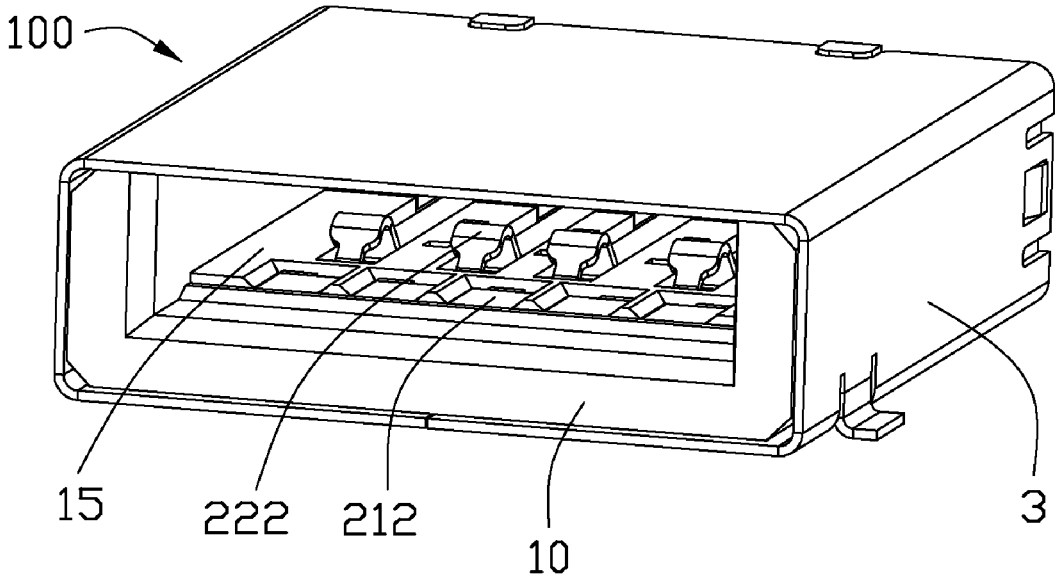
FIG. 1 is a perspective view of an electrical card connector according to a first embodiment of the present invention.
Figure 2:
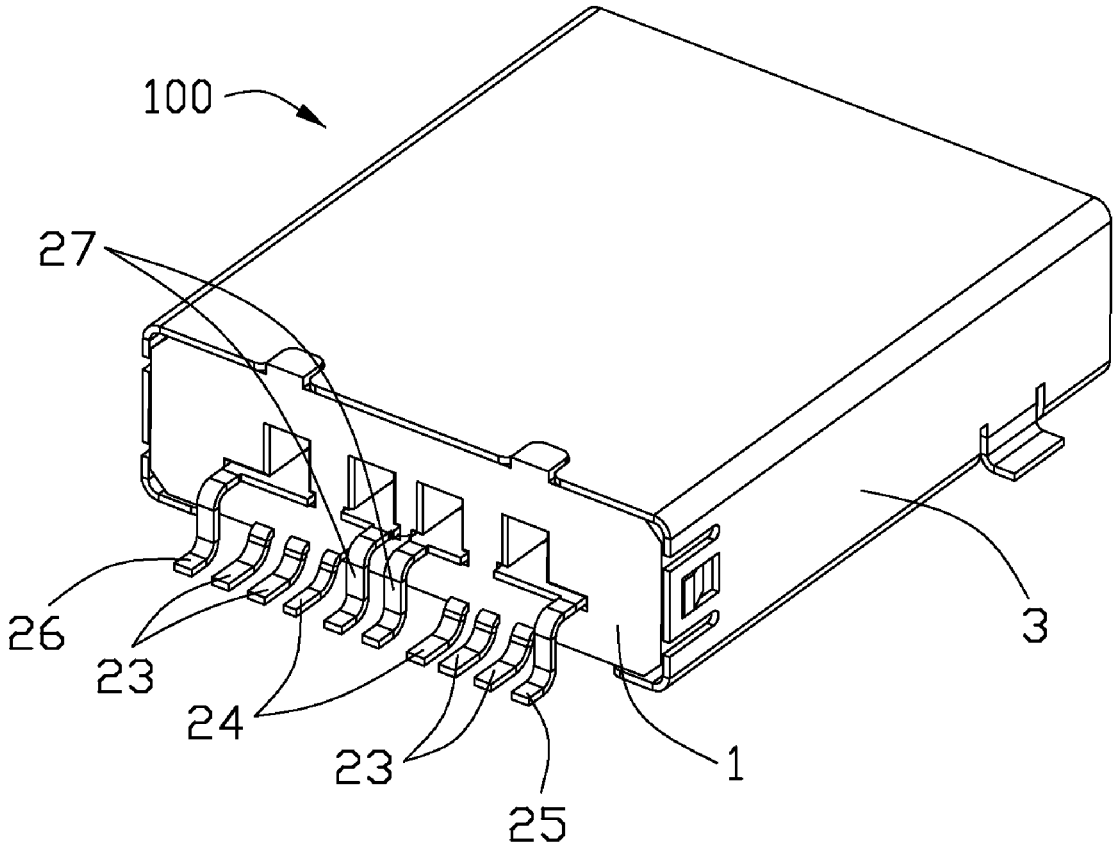
FIG. 2 is a view similar to FIG. 1, but taken from another aspect.
Figure 3:
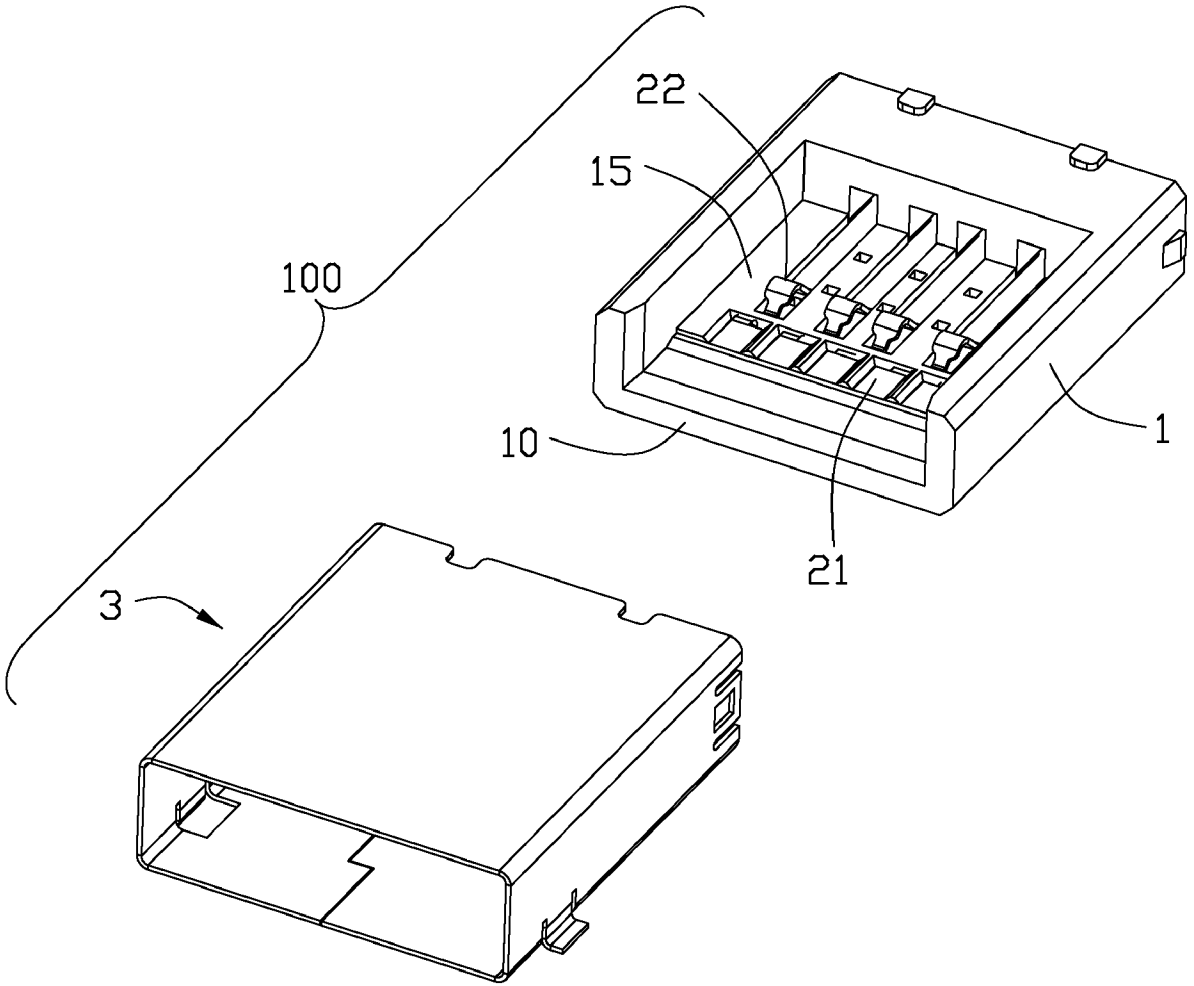
FIG. 3 is a partly exploded view of the electrical card connector shown in FIG. 1, in which a shell is separated from an insulative housing.
Figure 4:
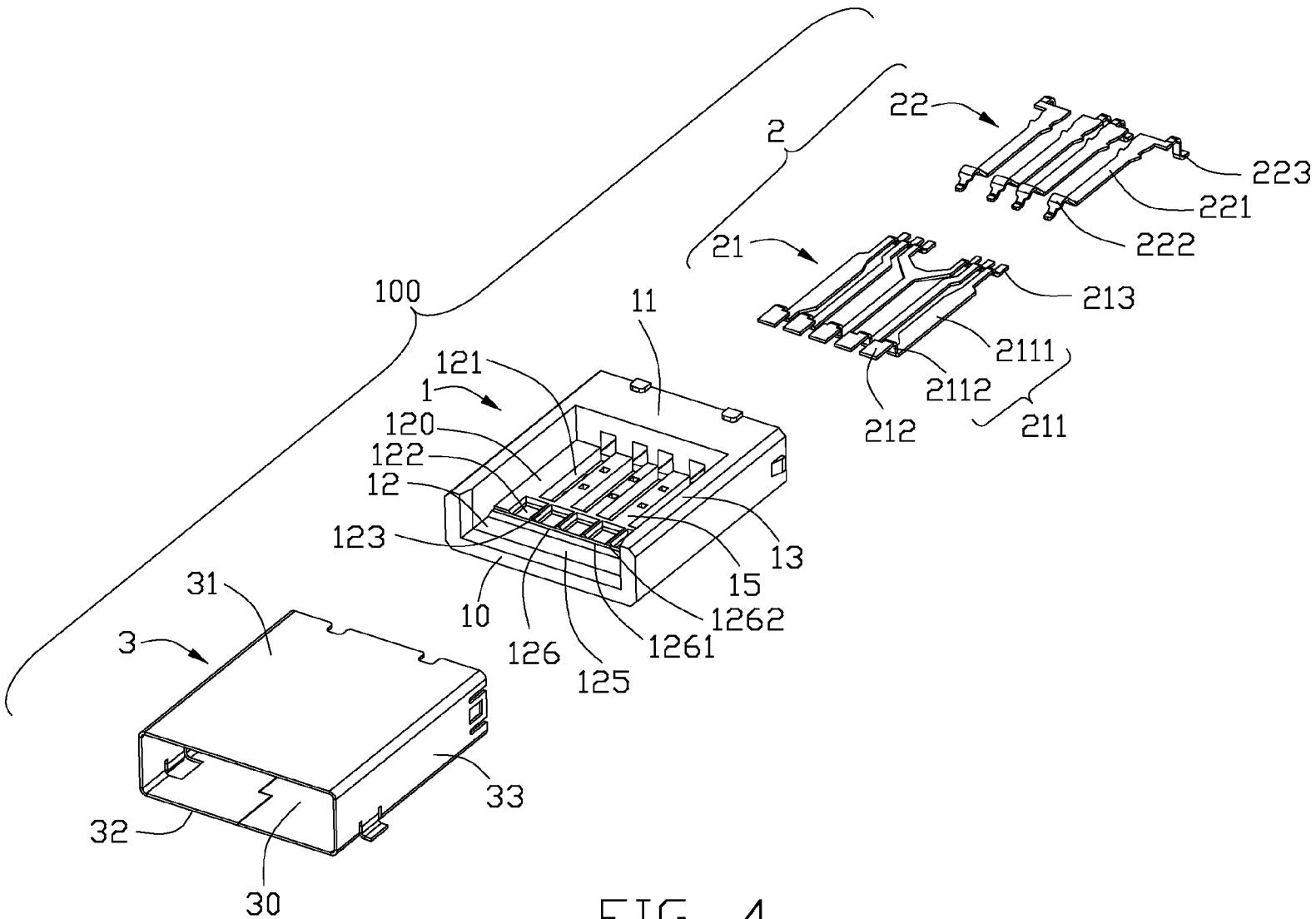
FIG. 4 is an exploded perspective view of the electrical card connector shown in FIG. 1.
Figure 5:
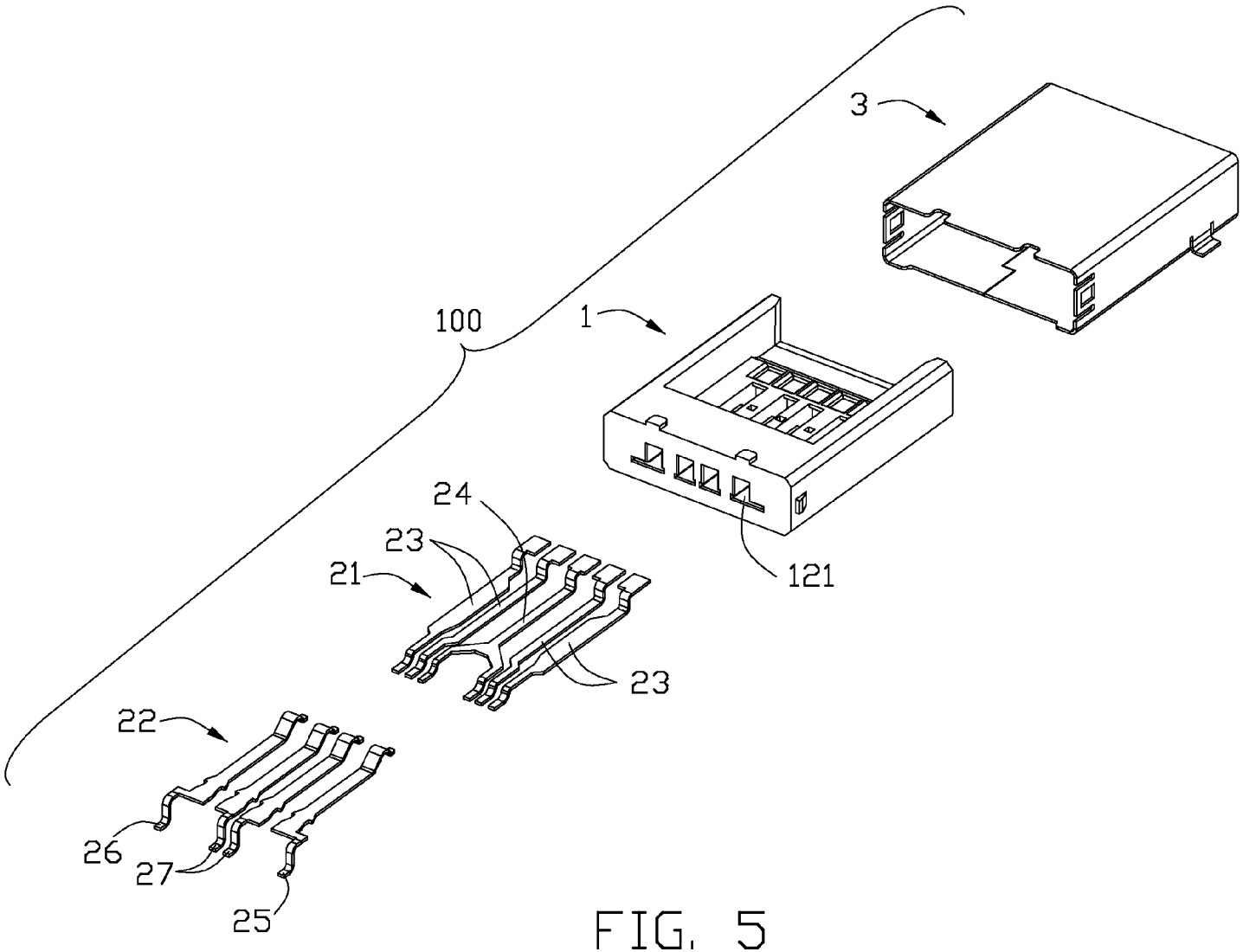
FIG. 5 is another exploded view of the electrical card connector taken from another side.

Reference will be made to the drawings to describe the present invention in detail, wherein depicted elements are not necessarily shown to scale and wherein like or similar elements are designated by same or similar reference numeral through the several views and same or similar terminology.

Referring to FIGS. 1-5, an electrical card connector 100 according to a first embodiment of the present invention is used to receive a memory card (not shown). The electrical card connector 100 comprises an insulative housing 1, a plurality of contacts 2 retained in the insulative housing 1, and a metallic shell 3 covering the insulative housing 1. The memory card has a row of arc-shaped first contact pads (not shown), and another row of planar second contact pads (not shown) located in front of the first contacts pads. The first contact pads consist of two pairs of differential contact pads, and a first grounding contact pad disposed between each pair of the differential contact pads. The second contact pads consist of a second grounding contact pad, a power contact pad and a pair of differential contact pads disposed between the second grounding contact pad and the power contact pad.

The insulative housing 1 includes a rear wall 11, a bottom wall 12, two opposite side walls 13 protruding upwardly from two opposed sides of the bottom wall 12, and an inserting slot 15 formed thereamong for receiving the memory card. The insulative housing 1 defines a front mating face 10 from which the inserting slot 15 extends backwardly. The bottom wall 12 has a horizontal support surface 120, a horizontal guiding surface 125 located in front of the support surface 120 and adjacent to the mating surface 10, and a leading block 126 disposed therebetween and connecting with the two side walls 13.

The bottom wall 12 defines a plurality of passageways 121 recessed in a rear portion of the supporting surface 120, a plurality of depressions 122 recessed in a front portion of the supporting surface 120, and a plurality of ribs 123 formed between adjacent depressions 122 and extending backwardly from the leading block 126. The passageways 121 and the depressions 122 are arranged in two rows along a front-to-back direction. Each row extends along a transverse direction perpendicular to the front-to-back direction. The passageways 121 extend along the front-to-back direction, and extend backwardly through the rear wall 11. The depressions 122 are communicated with the inserting slot 15 and located adjacent to the leading block 126. However, the depressions 122 are separated to the passageways 121 respectively, and are wholly located in front of the passageways 121.

The leading block 126 has an inclined surface 1261 extending slantly from the guiding surface 125, and a horizontal bridge surface 1262 extending backwardly from the inclined surface 1261. The guiding surface 125 is lower than the bridge surface 1262 which is lower than the supporting surface 120. The ribs 123 and the supporting surface 120 have a same height along a vertical direction perpendicular to the front-to-back direction.

The contacts 2 include a plurality of first contacts 21 for contacting with the first contact pads of the memory card, and a plurality of second contacts 22 for contacting the second contact pads of the memory card. Therefore, the first contacts 21 have five contacts and consist of two first pairs of differential contacts 23 and a first grounding contact 24 disposed between each the first pair of differential contacts 23. The second contacts 22 have four contacts and consist of a power contact 25, a second grounding contact 26 and a second pair of differential contacts 27 disposed between the power contact 25 and the second grounding contact 26. The first contacts 21 each has a first retaining portion 211 insert molded in the bottom wall 12 of the insulative housing 1, a planar first contact portion 212 extending forwardly from the first retaining portion 211, and a first soldering portion 213 extending backwardly beyond the insulative housing 1 from the first retaining portion 211. The first retaining portion 211 has a horizontal portion 2111 connecting to the first soldering portion 213, and a vertical portion 2112 extending upwardly from the horizontal portion 2111 to the first contact portion 212. The first contact portions 212 are non-elastic in order to be retained on inner surfaces of the depressions 122 of the bottom wall 12 of the insulative housing 1, respectively. The first contact portions 212 are located below the support surface 120.

The second contacts 22 each has a second retaining portion 221 retained in the passageways 121, an arc-shaped second contact portion 222 extending upwardly into the inserting slot 15 from the second retaining portion 221, and a second soldering portion 223 extending backwardly beyond the insulative housing 1 from the second retaining portion 221. The second contact portions 222 are located beyond the supporting surface 120 under a condition that the second contact portions 222 deflectly to be received in the passageways 121 during the memory card is inserted in the inserting slot 15. The first contact portions 212 of the first contacts 21 and the contact portions 222 of the second contacts 22 are essentially alternately arranged with each other in the transverse direction, and the second contact portions 222 are located behind the first contact portion 212 in the front-to-back direction. The first grounding contact 24 defines a split to form two soldering portions 213 spaced from each other in the transverse direction. The first soldering portions 213 and the second soldering portions 223 are arranged in one row along the transverse direction. All of the first soldering portions 213 are arranged between the second soldering portions 223 of the power contact 25 and the second grounding contact 26 of the second contacts 22. In another word, relative to the soldering portions 213, 223, two second soldering portions 223 of the power contact 25 and the second grounding contact 26 are arranged at two outermost sides. The second soldering portions 223 of the second pair of differential contacts 27 of the second contacts 22 are arranged between the two first soldering portions 213 of the first grounding contact 24 of the first contacts 21.

The shell 3 has a top plate 31, a bottom plate 32 opposite to the top plate 31, two side plates 33 bent and extending downwardly from two opposite sides of the top plate 31 to the bottom plate 32 to form a receiving space 30 thereamong. The insulative housing 1 is retained in the receiving space 30. The top plate 31 covers a top portion of the inserting slot 15 of the insulative housing 1. The top plate 31 and the side plates 33 cover the bottom wall 12 and the side walls 13 of the insulative housing 1 directly, respectively.

Respect to the prior art, the electrical card connector 100 may satisfy requirement of users in future via adding the first contacts 21 with the first contact portions 212.

Figure 6:
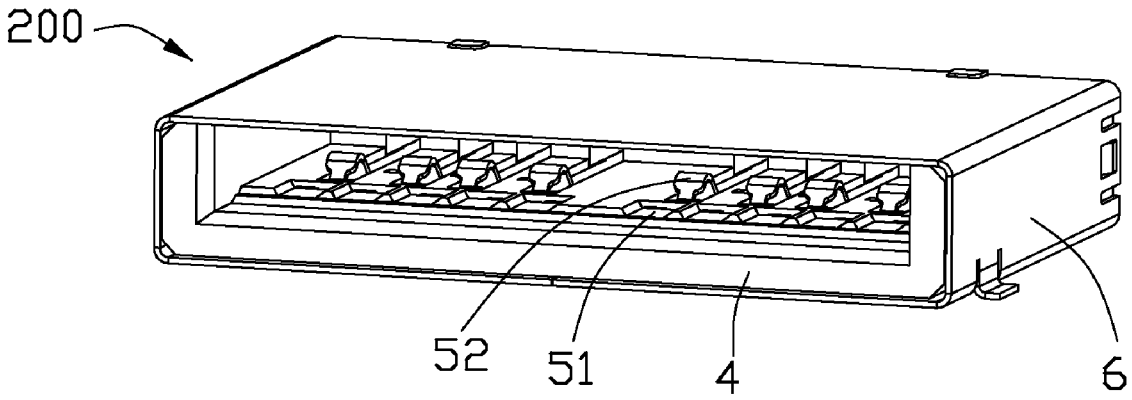
FIG. 6 is a perspective view of an electrical card connector according to a second embodiment of the present invention.
Figure 7:
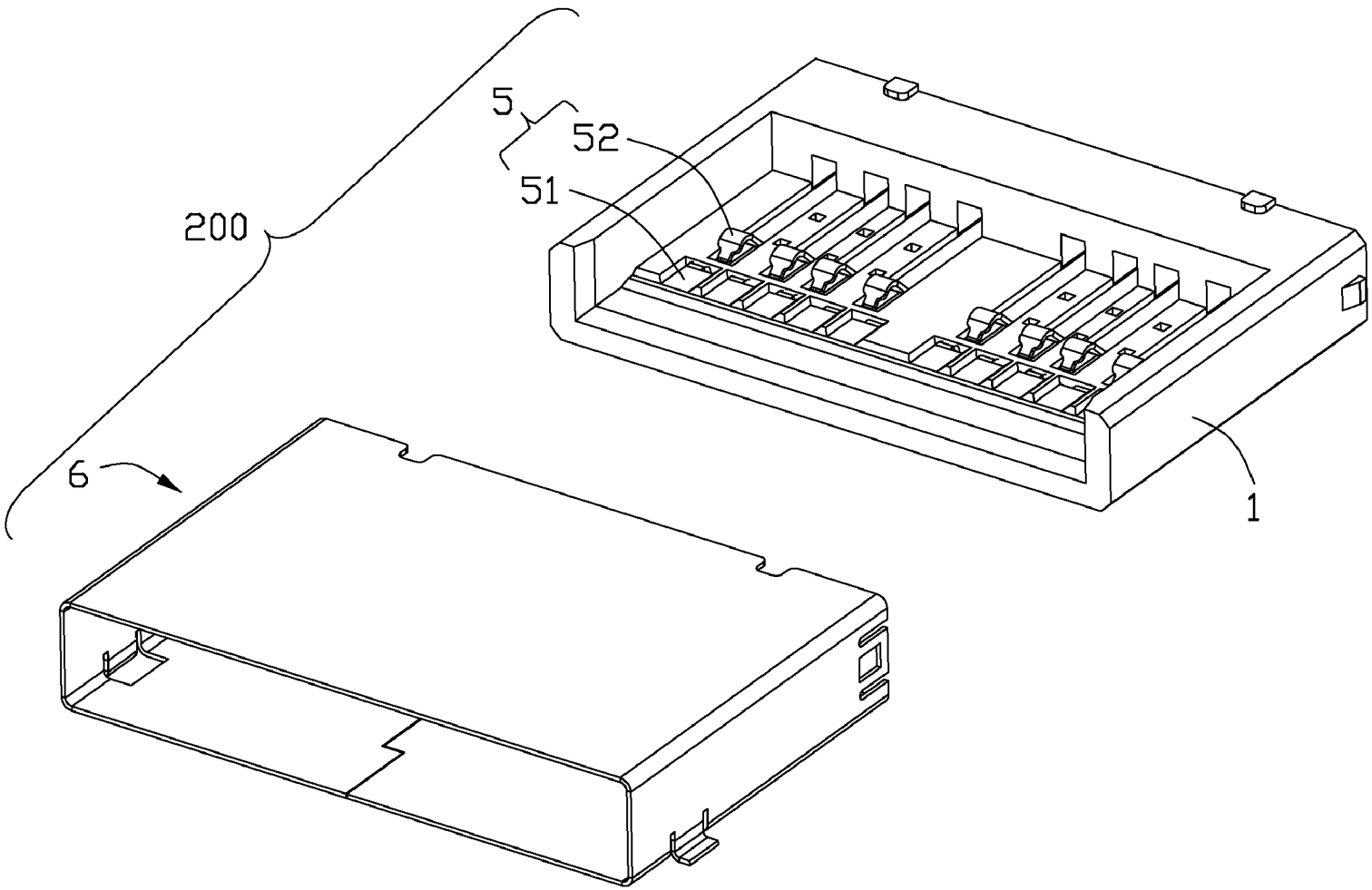
FIG. 7 is a partly exploded view of the electrical card connector shown in FIG. 6, in which a shell is separated from an insulative housing.
Figure 8:
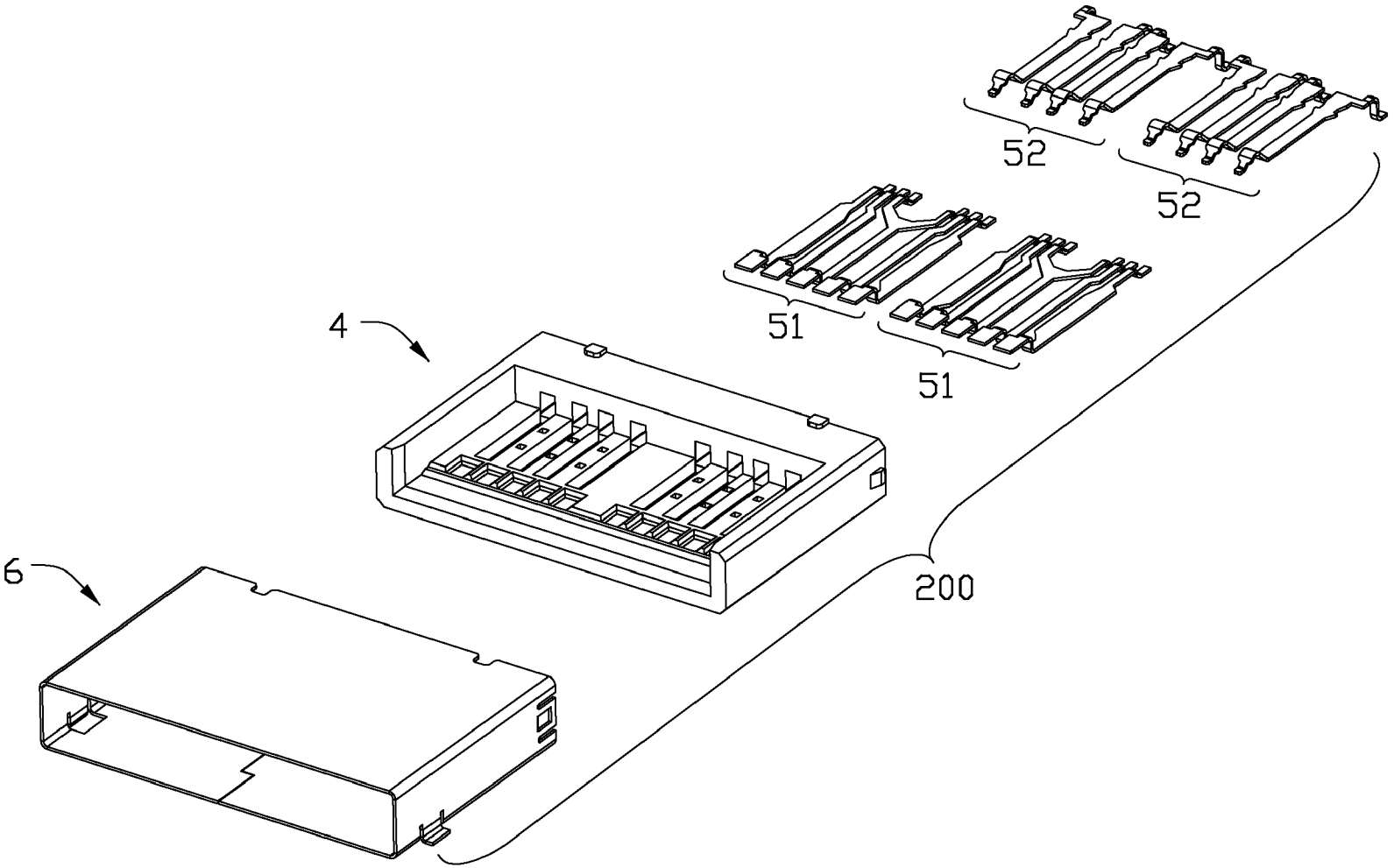
FIG. 8 is an exploded perspective view of the electrical card connector shown in FIG. 6.

Referring to FIGS. 6-8, another electrical card connector 200 is disclosed according to a second embodiment of the present invention. The electrical card connector 200 is wider than the electrical card connector 100. The electrical card connector 200 also includes an insulative housing 4, a plurality of contacts 5 retained in the insulative housing 4, and a metallic shell 6 enclosing the insulative housing 1. The contacts 5 include two contact groups with each contact group same to the contacts 2 in the first embodiment. Each contact group includes a plurality of first contacts 51 same to the first contacts 21 in the first embodiment, and a plurality of second contacts 52 same to the second contacts 22 in the first embodiment. The two contact groups are aligned with each other along a transverse direction perpendicular to a front-to-back direction. The contacts 5 define a space between the two contact groups is much larger than that of adjacent two contacts in each contact group along the transverse direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector, comprising:

an insulative housing having an inserting slot, and a bottom wall under the inserting slot, the bottom wall defining a supporting surface extending along a front-to-back direction, a horizontal guiding surface located in front of the supporting surface, and a plurality of depressions recessed from the supporting surface and arranged in one row along a transverse direction perpendicular to the front-to-back direction, the guiding surface disposed lower than the supporting surface, the depressions being communicated with the inserting slot;

a plurality of first contacts each having a planar first contact portion retained in the depression, a first soldering portion extending beyond the insulative housing, and a first retaining portion connecting with the first contact portion and the first soldering portion; and a plurality of second contacts each having an arc-shaped second contact portion extending upwardly beyond the supporting surface and protruding into the inserting slot, a second soldering portion extending beyond the insulative housing, and a second retaining portion connecting with the second contact portion and the second soldering portion, the second contact portions located behind the first contact portions.

2. The electrical card connector as claimed in claim 1, wherein the bottom wall defines a leading block extending along the transverse direction and surrounding front sides of the depressions, the leading block is located between the supporting surface and the guiding surface along the font-to-back direction, and defines an inclined surface extending slantly from the guiding surface, and a horizontal bridge surface extending backwardly from the inclined surface, the bridge surface is lower than the supporting surface.

3. The electrical card connector as claimed in claim 2, wherein the bottom wall defines a plurality of ribs disposed between adjacent depressions and extending backwardly from the leading block, the ribs and the supporting surface have a same height along a vertical direction perpendicular to the front-to-back direction.

4. The electrical card connector as claimed in claim 2, wherein the insulative housing includes a pair of side walls protruding upwardly from two opposite sides of the bottom wall to form the inserting slot thereamong, the leading block connects with the pair of side walls.

5. The electrical card connector as claimed in claim 1, wherein the first contact portions and the second contact portions are essentially alternately arranged with each other in the transverse direction, the first contacts are non-elastic, the bottom wall defines a plurality of passageways to retain the second retaining portions therein, the second contact portions are received in the passageways when a memory card is inserted in the inserting slot.

6. The electrical card connector as claimed in claim 1, wherein the first contacts include two first pairs of differential contacts, and a first grounding contact disposed between the two first pair of the differential contacts, the second contacts include a power contacts, a second grounding contact, and a second pair of differential contacts, the first and second soldering portions are arranged in one row in the transverse direction under a condition that all of the first soldering portions are located between the second soldering portions of the power contact and the second grounding contact in the transverse direction.

7. The electrical card connector as claimed in claim 6, wherein the first grounding contact defines a split to form two first soldering portions spaced from each other in the transverse direction, two second soldering portions of the power contact and the second grounding contact are arranged at two outermost sides of the row, the second soldering portions of the second pair of differential contacts of the second contacts are arranged between the two tail portions of the first grounding contact of the first contacts.

8. The electrical card connector as claimed in claim 1, wherein the first contacts are divided into two contact groups each including a plurality of first contacts and a plurality of second contacts, the two contact groups are aligned with each other along the transverse direction, the contacts define a space between the two contact groups is much larger than that of each two adjacent contacts in each contact group along the transverse direction.

9. An electrical card connector for receiving a memory card with a first row of elastic contact pads and a second row of non-elastic contact pads behind the elastic contact pads, comprising:

an insulative housing defining an inserting slot extending along a front-to-back direction;

a plurality of first contacts received in the insulative housing and including a first pair of differential contacts, a second pair of differential contacts, and a first grounding contact located between the first and second pairs of differential contacts, each of the first contacts comprising a first non-elastic contact portion exposed in the inserting slot for engaging with the elastic contact pads of the memory card, a first soldering portion located on a rear side of the insulative housing; and a plurality of second contacts received in the insulative housing and including a power contact, a second grounding contact, and a third pair of differential contacts located between the power contact and the second grounding contact, each of the second contacts comprising a second elastic contact portion exposed in the inserting slot and located higher than the first contact portions, and a second soldering portion located on a rear side of the insulative housing, the second contact portions adapted for engaging with the non-elastic contact pads of the memory card;

wherein the first and second soldering portions are arranged in one row in a transverse direction perpendicular to the front-to-back direction, the first grounding contact defines a split to form two first soldering portions spaced from each other in the transverse direction, the second soldering portions of the third pair of differential contacts are arranged between and directly adjacent to the two first soldering portions of the first grounding contact.

10. The electrical card connector as claimed in claim 9, wherein two second soldering portions of the power contact and the second grounding contact are arranged at two outermost sides of the row.

11. The electrical card connector as claimed in claim 9, wherein the bottom wall has a supporting surface, a horizontal guiding surface located in front of the supporting surface and being lower than the supporting surface, a plurality of passageways recessed from the supporting surface, and a plurality of depression recessed from the supporting surface, the depressions are separated forwardly to the passageways respectively, the first contact portions are retained in the depressions respectively, the second contact portions protrude slantly beyond the passageways.

12. The electrical card connector as claimed in claim 11, wherein the insulative housing has two opposite side walls extending upwardly from two opposite sides of the bottom wall, the bottom wall further has a leading block connecting with the two side walls, and protruding upwardly from the guiding surface, the leading bock is around the depressions and has an inclined surface extending upwardly from the guiding surface, and a horizontal bridge surface extending backwardly from the inclined surface, the bridge surface is located lower than the supporting surface.

13. An electrical card connector comprising:

an insulative housing defining a mating face with a card receiving space thereabouts;

a plurality of first contacts disposed in the housing with non-deflectable first contacting sections exposed upon the mating face, first soldering sections on a rear side of the housing, each of said first contacts further defining a first connecting section extending along a front-to-back direction and located between the first contacting section and the first soldering section; and a plurality of second contacts disposed in the housing with deflectable second contacting sections exposed upon the mating face and second soldering sections on the rear side of the housing, each of said second contacts further defining a second connecting section extending along the front-to-back direction and located between the second contacting section and the second soldering section; wherein the first connecting sections and the second connecting sections are located at two different levels while the first soldering sections and the second soldering sections are located in a same plane under condition that there are five first contacts including two differential pairs commonly sandwiching one grounding contact therebetween in transverse direction perpendicular to said front-to-back direction, and there are four second contacts including a power contact cooperating with another grounding contact to sandwich another differential pair therebetween in the transverse direction, and the second soldering sections of the differential pair of the second contacts are located at a center position sandwiched by the first soldering sections of the two differential pair of the first contacts in the transverse direction, and the second soldering sections of the power contact and the grounding contact of the second contacts further sandwich the first soldering sections of the two differential pair of the first contacts therebetween in the transverse direction.

14. The electrical card connector as claimed in claim 13, wherein the first soldering section of the grounding contact of the first contact is split into two pieces cooperating with each other to sandwich the second soldering sections of the differential pair of the second contact.

15. The electrical card connector as claimed in claim 14, wherein the split two pieces of the soldering section of the grounding contact of the first contact are directly outwardly neighboring to the soldering section of the differential pairs of the corresponding second contacts in the transverse direction.

16. The electrical card connector as claimed in claim 14, wherein the split two pieces of the soldering section of the grounding contact of the first contact is spaced from each other with a distance larger than a dimension of the corresponding first contacting section of the same grounding contact in the transverse direction.

17. The electrical card connector as claimed in claim 13, wherein the housing defines a mounting face for mounting to a printed circuit board, and the first connecting sections are closer to the mounting face than the second connecting sections.

18. The electrical card connector as claimed in claim 13, wherein the soldering sections of each of the differential pair of both said first contacts and the second contacts defines a pitch in the transverse direction which is smaller than that defined by the corresponding contacting sections of the same differential pair.

* * * * *